US006562755B1

(12) United States Patent
Halbrook, Jr. et al.

(10) Patent No.: US 6,562,755 B1
(45) Date of Patent: May 13, 2003

(54) THERMAL PAPER WITH SECURITY FEATURES

(75) Inventors: Wendell B. Halbrook, Jr., Waynesville, OH (US); Mary Ann Wehr, Hamilton, OH (US)

(73) Assignee: NCR Corporation, Dayton, OH (US)

( * ) Notice: Subject to any disclaimer, the term of this patent is extended or adjusted under 35 U.S.C. 154(b) by 119 days.

(21) Appl. No.: 09/699,486

(22) Filed: Oct. 31, 2000

(51) Int. Cl.[7] ..... B41M 5/30
(52) U.S. Cl. ..... 503/201; 503/200; 503/206
(58) Field of Search ..... 503/200, 206, 503/226, 201

(56) References Cited

U.S. PATENT DOCUMENTS

| | | | | |
|---|---|---|---|---|
| 2,800,457 | A | | 7/1957 | Green et al. |
| 3,016,308 | A | | 1/1962 | Macaulay |
| 3,116,206 | A | | 12/1963 | Brynko et al. |
| 3,167,602 | A | | 1/1965 | Bentov et al. |
| 3,202,533 | A | | 8/1965 | Sacshel et al. |
| 3,429,827 | A | | 2/1969 | Ruus |
| 4,150,997 | A | | 4/1979 | Hayes |
| 4,153,593 | A | | 5/1979 | Zabiak et al. |
| 4,328,332 | A | | 5/1982 | Hayes et al. |
| 4,370,370 | A | | 1/1983 | Iwata et al. |
| 4,388,362 | A | | 6/1983 | Iwata et al. |
| 4,424,245 | A | | 1/1984 | Maruta et al. |
| 4,425,161 | A | | 1/1984 | Shibahashi et al. |
| 4,444,819 | A | | 4/1984 | Maruta et al. |
| 4,507,669 | A | | 3/1985 | Sakamoto et al. |
| 4,551,738 | A | | 11/1985 | Maruta et al. |
| 4,682,194 | A | | 7/1987 | Usami et al. |
| 4,722,921 | A | | 2/1988 | Kiritani et al. |
| 4,740,495 | A | | 4/1988 | Marinelli et al. |
| 4,742,043 | A | | 5/1988 | Tanaka et al. |
| 4,783,493 | A | | 11/1988 | Motegi et al. |
| 4,886,744 | A | | 12/1989 | Arnost et al. |
| 4,942,150 | A | | 7/1990 | Usami et al. |
| 5,158,924 | A | | 10/1992 | Konagaya et al. |
| 5,292,855 | A | | 3/1994 | Krutak et al. |
| 5,336,714 | A | | 8/1994 | Kruta et al. |
| 5,397,819 | A | | 3/1995 | Krutak et al. |
| 5,423,432 | A | | 6/1995 | Krutak et al. |
| 5,427,415 | A | | 6/1995 | Chang |
| 5,461,136 | A | | 10/1995 | Krutak et al. |
| 5,500,040 | A | | 3/1996 | Fujinami |
| 5,503,904 | A | | 4/1996 | Yoshinaga et al. |
| 5,583,223 | A | | 12/1996 | Fischer et al. |
| 5,595,955 | A | | 1/1997 | Chang et al. |
| 5,614,008 | A | | 3/1997 | Escano et al. |
| 5,665,151 | A | | 9/1997 | Escano et al. |
| 5,690,857 | A | | 11/1997 | Osterried et al. |
| 5,703,229 | A | | 12/1997 | Krutak et al. |
| 5,741,592 | A | | 4/1998 | Lewis et al. |
| 5,826,915 | A | | 10/1998 | Gregory, Jr. ..... 283/67 |
| 5,843,864 | A | | 12/1998 | Popp et al. |
| 5,883,043 | A | | 3/1999 | Halbrook, Jr. et al. |
| 5,912,205 | A | * | 6/1999 | Lakes et al. ..... 503/207 |
| 6,048,387 | A | | 4/2000 | Shibahashi et al. |
| 6,060,426 | A | | 5/2000 | Tan et al. |
| 6,060,428 | A | | 5/2000 | Chang et al. |

* cited by examiner

*Primary Examiner*—Bruce H. Hess
(74) *Attorney, Agent, or Firm*—Millen, White, Zelano & Branigan, P.C.

(57) ABSTRACT

Thermosensitive recording materials such as thermal paper with a thermochromic composition applied to the back thereof and overcoated with a protective coating provide a security feature without pre-reacting the active compounds in the thermosensitive recording materials or causing the loss of the color-forming properties of the thermosensitive recording materials. Methods for preparing thermal papers with a thermochromic composition as a security feature apply a thermochromic printing ink to the opposite side of the thermosensitive layer of the thermal paper followed by a coating composition that forms a protective coating over the thermochromic ink. The thermochromic printing ink and coating composition are selected so as not to pre-react with the thermosensitive layer or cause the loss of the color-forming properties of the thermosensitive layer.

20 Claims, 1 Drawing Sheet

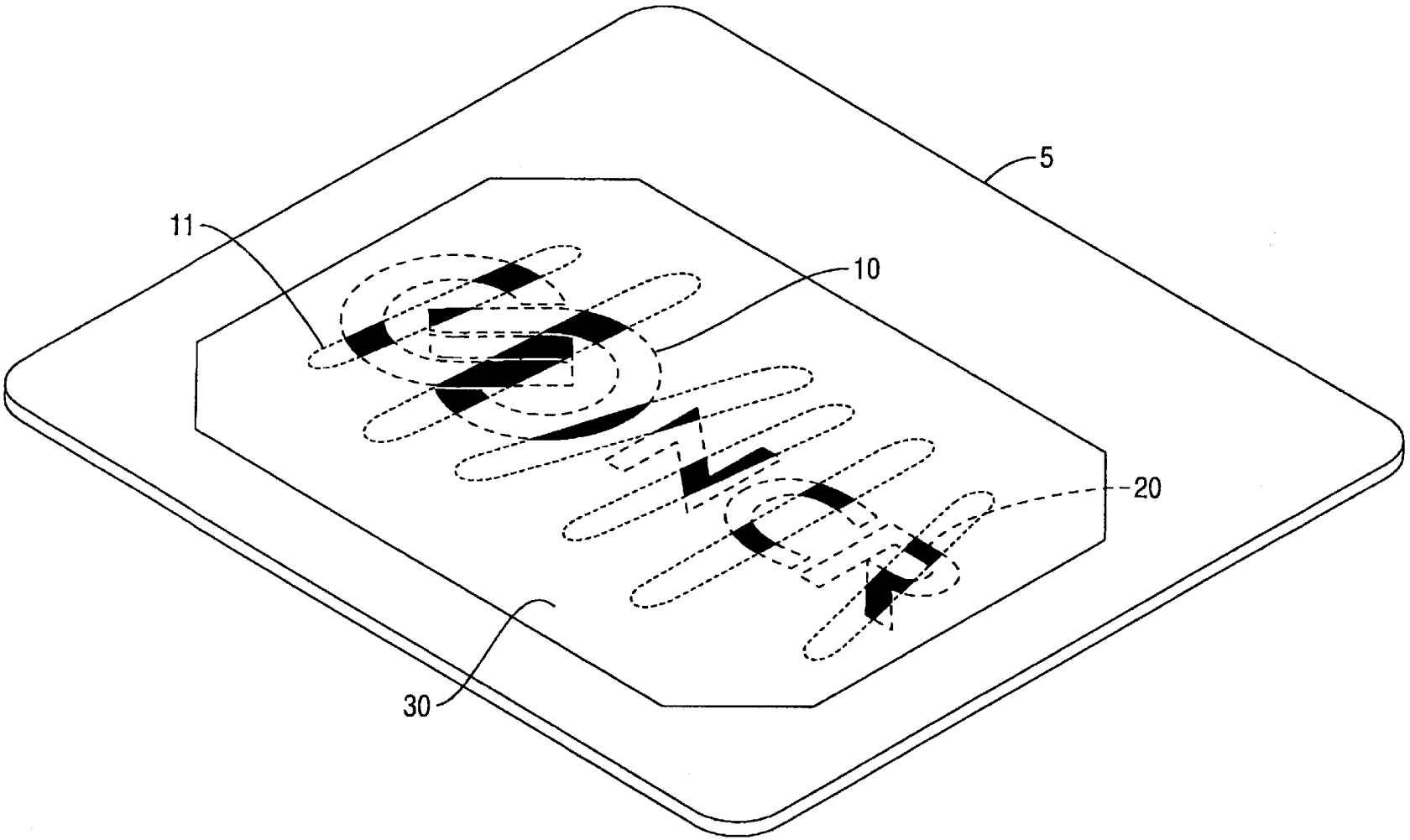
5
20
10
11
30

THERMAL PAPER WITH SECURITY FEATURES

FIELD OF THE INVENTION

The present invention relates to security inks used to thwart counterfeiting of printed commercial documents such as sales transaction records and receipts. More particularly, the invention relates to the use of security features on thermosensitive recording materials such as thermal paper.

BACKGROUND OF THE INVENTION

Thermosensitive recording materials provide for the generation of print or designs without an ink ribbon by the application of heat energy thereto. Thermal paper is a typical example of a thermosensitive recording medium and typically comprises a base sheet, a base coating and a thermosensitive coating. Special color forming chemicals and additives are present in the thermosensitive coatings such that when heat is applied by a thermal head, the color forming chemicals react to develop the desired print or image.

The most common type of thermosensitive coating is the dye-developing type. There are three main color producing components in a dye developing-type thermal paper which are: a colorless dye (color former), a bisphenol or an acidic material (color developer) and a sensitizer. These solid materials are reduced to very small particles by grinding and incorporated into a coating formulation along with any optional additives such as pigments, binders and lubricants. This coating formulation is then applied to the surface of paper, typically a base sheet and base coating, or other support system using one of the various types of conventional coating application methods and dried. Images are formed on the coated surfaces by the application of heat to melt and interact the three color producing materials.

The use of special inks as a security measure, such as optically variable inks which change color when exposed to a light source other than ambient light and inks which provide latent images, is well known. Optically variable inks include fluorescent compounds which respond to infrared or ultraviolet light. Examples of printing inks which fluoresce under ultraviolet radiation, such as fluorescein, are described in U.S. Pat. Nos. 4,153,593; 4,328,332 and 4,150,997. Thermochromic compounds which change color at different temperatures is another type of optically variable ink. Examples of thermochromic compounds, also referred to as heat activatable chromogenic compounds, are described in U.S. Pat. Nos. 4,425,161; 5,427,415; 5,500,040; 5,583,223; 5,595,955; 5,690,857; 5,826,915; 6,048,347; and 6,060,428. Near-infrared fluorescent (NIRF) compounds provide another form of latent image as a means of security by reflecting radiation in the near-infrared range. Examples of NIRF compounds are described in U.S. Pat. No. 5,292,855, issued Mar. 8, 1994, U.S. Pat. No. 5,423,432 issued Jan. 13, 1995, and U.S. Pat. No. 5,336,714, issued Aug. 9, 1994. To be useful as a security measure on printed commercial documents, latent images must be well camouflaged but readily and easily viewable to the user. Preferably, this is accomplished by a simple procedure, particularly where records are only casually inspected, such as sales receipts and transaction records.

Where security features are desired from special compounds for thermal paper, these compounds must not prereact the reactive components within the therrnosensitive coating of the thermal paper or prevent the formation of an image on the thermal paper from thermal printing. This will detract from the thermal paper's printing performance. Certain chemical factors can adversely affect and degrade the performance of the thermosensitive coating and should be avoided such as some organic solvents (ketones), plasticizers (polyethylene glycol type), amines (ammonia) and certain oils (soy oil). The use of fluorescent compounds as a security feature for thermosensitive recording materials is described in U.S. Pat. No. 5,883,043. The use of NIRF compounds as a security feature for thermosensitive recording materials is described in U.S. Pat. No. 6,060,426, assigned to the same assignee as the present invention. While techniques for using fluorescent compounds and NIRF compounds as security features for thermosensitive recording materials have been effective, with the ease of counterfeiting made possible through the advent of today's personal computers and color copiers, it is desirable to provide additional and alternative means of security, such as through the use of thermochromic compounds.

To protect thermal paper from environmental conditions, and premature coloration from handling, a number of developments have been made. One is to produce a barrier or protection layer on top of the thermal coating (see U.S. Pat. Nos. 4,370,370; 4,388,362; 4,424,245; 4,444,819; 4,507,669; and 4,551,738). Another approach is to encapsulate the reactive components in microcapsules which rupture or are permeable when exposed to heat. See U.S. Pat. Nos. 4,682,194; 4,722,921; 4,742,043; 4,783,493; and 4,942,150. These protective measures do not always prevent premature coloration of the thermosensitive coating.

U.S. Pat. No. 5,595,955 discloses coating a latent image comprised of a thermochromic ink, referred to therein as a "reversible thermosensitive recording material," printed on a support with a thin protective layer.

SUMMARY OF THE INVENTION

The present invention provides a thermosensitive recording material such as thermal paper with a thermochromic compound as a security feature printed on the side opposite the thermosensitive layer to prevent counterfeiting. The thermochromic compound is overcoated with a protective coating, preferably UV cured, so as not to pre-react the reactive components of said thermosensitive coating or cause the loss of the color-forming properties of the thermosensitive coating.

The thermochromic compound is shielded from reaction with the reactive components of the thermosensitive coating by a protective coating. This protective coating can be a UV cured coating or an air dried flexographic or lithographic coating. Such shielding preserves the activity of the thermochromic compounds and also the activity of the thermosensitive coating of the thermal paper so that it will still generate color when exposed to heat.

The thermochromic compounds provide a unique mode of security through their change in color in response to heat. Printed images which contain thermochromic compounds and another optically variable compound, such as a fluorescent compound, provide two modes of security.

The present invention also provides a method for preparing a thermosensitive recording medium having a thermochromic compound incorporated therein as a security feature without premature coloration of the thermosensitive layer. This method comprises printing a mark or image on the side of the thermosensitive recording medium opposite the thermosensitive coating using a thermochromic compound and overcoating the thermochromic compound with a protective coating, preferably a UV curable protective coating. The protective coating can be applied by conventional coating processes, such as flexography and lithography, and where necessary, cured. Conventional UV curing techniques can be used where appropriate.

The thermosensitive recording media of the present invention have a base sheet with a thermosensitive coating. Optionally, a conventional base coating is positioned between the thermosensitive coating and the base sheet. The base coating is typically comprised of inert pigments and binders and provides a smooth surface for the thermosensitive coating. This thermosensitive coating is preferably of the dye-developing type. Particularly suitable dye developer systems are those wherein the reactive dyes are colorless or white-colored which become dark colored when melted and exposed to a color developer. Such dyes are typically basic substances which become colored when oxidized by acidic compounds or bisphenol compounds. In these dye-developer systems, sensitizers are typically mixed with the dyes to form a blend with a reduced melting point. This reduces the amount of heat necessary to melt the dye and obtain reaction with the color developer. The components of the thermosensitive coating are often determined by the operating temperature of the thermal printer to be used. The operating temperature of conventional thermal printers varies widely, typically within the range of from 50° C. to 250° C. One skilled in the art can readily determine the melting point necessary for a desired application and select a dye and developer accordingly, or select a conventional thermal paper with a thermosensitive coating on one side. A well-known dye is that identified in the art as "ODB-II." A preferred color developer is bisphenol A and a preferred sensitizer is M-terphenyl.

Color formers suitable for use in the coating formulations in thermosensitive recording materials of this invention are leuco dyes. Leuco dyes are colorless or light-colored basic substances, which become colored when oxidized by acidic substances. Examples of leuco dyes that can be used herein are leuco bases of triphenylmethane dyes represented by formula I in U.S. Pat. No. 5,741,592. Specific examples of such dyes are: 3,3-bis(p-dimethylaminophenyl)-phthalide, 3,3-bis(p-dimethylaminophenyl)-6-dimethylaminophthalide (Crystal Violet Lactone), 3,3-bis(p-dimethylaminophenyl)-6-diethylaminophthalide, 3,3-bis(p-dimethylaminophenyl)-6-chlorophthalide, and 3,3-bis(p-dibutylaminophenyl)-phthalide.

Leuco bases of fluoran dyes represented by formula II in U.S. Pat. No. 5,741,592, are also suitable. Some examples of these fluoran dyes are: 3-cyclohexylamino-6-chlorofluoran, 3-(N-N-diethylamino)-5-methyl-7-(N,N-Dibenzylamino) fluoran, 3-dimethylamino-5,7-dimethylfluoran and 3-diethylamino-7-methylfluoran. Other suitable fluoran dyes include: 3-diethylamino-6-methyl-7-chlorofluoran, 3-pyrrolidino-6-methyl-7-anilinofluoran, and 2-[3,6-bis (diethylamino)-9-(0-chloroanilino)xanthylbenzoic acid lactam].

Also suitable are lactone compounds represented by formula III in U.S. Pat. No. 5,741,592 and the following compounds: 3-(2'-hydroxy-4'-dimethylaminophenyl)-3-(2'[-methoxy-5'-chlorophenyl)phthalide, 3-(2'-hydroxy-4'-dimethylaminophenyl)-3-(2'-methoxy-5'-nitrophenyl-phthalide, 3-(2'-hydroxy-4'-diethylaminophenyl)-3-(2'-methoxy-5'-methylphenyl)phthalide, and 3-(2'-methoxy-4'-dimethylaminophenyl)-3-(2'-hydroxy-4'-chloro-5'-methylphenyl)-phthalide.

There are many substances which change the color of the dyes by oxidizing them and function as developers. Color developers suitable for the coating formulations and thermosensitive recording materials of this invention are phenol compounds, organic acids or metal salts thereof and hydroxybenzoic acid esters.

Preferred color developers are phenol compounds and organic acids which melt at about 50° C. to 250° C. and are sparingly soluble in water. Examples of suitable phenol compounds include 4,4'-isopropylene-diphenol (bisphenol A), p-tert-butylphenol, 2-4-dinitrophenol, 3,4-dichlorophenol, p-phenylphenol, 4,4-cyclohexylidenediphenol 2,2-bis(4'-hydroxyphenyl)-n-heptane and 4,4'-cyclohexylidene phenol. Useful examples of organic acid and metal salts thereof include 3-tert-butylsalicylic acid, 3,5-tert-butylsalicylic acid, 5-a-methylbenzylsalicylic acid and salts thereof of zinc, lead, aluminum, magnesium or nickel.

Sensitizers or thermosensitivity promoter agents are preferably used in the thermal papers of the present invention to give a good color density. The exact mechanism by which the sensitizer helps in the color forming reaction is not well known. It is generally believed that the sensitizer forms a eutectic compound with one or both of the color forming compounds. This brings down the melting point of these compounds and thus helps the color forming reaction take place at a considerably lower temperature. Some of the common sensitizers which are suitable are fatty acid amide compounds such as acetamide, stearic acid amide, linolenic acid amide, lauric acid amide, myristic acid amide, methylol compounds or the above mentioned fatty acid amides such as methylene-bis(stearamide), and ethylene-bis(stearamide), and compounds of p-hydroxybenzoic acid esters such as methyl p-hydroxybenzoate, n-propyl p-hydroxybenzoate, isopropyl p-hydroxybenzoate, benzyl p-hydroxybenzoate.

Conventional base sheets and base coatings suitable for use in thermosensitive recording media can be used in the papers of the present invention. The base sheet or base coating must not contain any reactive elements which would prematurely color the thermosensitive coating or cause the loss of the color-forming properties of the thermosensitive coating. The thermosensitive coating can vary in composition, as is conventionally known in the art, including the encapsulation of components therein and the use of protective layers thereon to prevent premature coloration during handling. The thermosensitive coatings can also be applied by conventional methods using conventional equipment.

The thermochromic compounds employed in the thermosensitive recording media and methods of the present invention are selected to provide a security measure that is responsive to temperatures above ambient temperature (above 20° C.) and below the temperature of activation for the thermosensitive recording media (typically about 60° C.). One class of preferred thermochromic compounds are active at temperatures in the range of 21° C. to 40° C., (about 70° F.–100° F.). The compounds may be responsive to temperatures above this range but heating the thermosensitive recording media to temperatures above this range will activate most conventional thermosensitive layers. The thermochromic compounds are preferably stable to air, sun light and fluorescent light. When a flexographic process is employed to deposit the thermochromic compounds, these compounds are also preferably soluble, dispersible or emulsifiable in water to provide, "water based" formulations or inks. When a lithographic process is employed to deposit the thermochromic compounds, these compounds can be used in a hydrophobic or oil based formulation or ink. Water-based formulations are preferred to avoid the use of solvents that may pre-react the thermosensitive layer or cause the loss of the color-forming properties of the thermosensitive layer. The thermochromic compounds need not absorb or transmit visible light under ambient indoor conditions or when illuminated by light with wavelengths outside of the visible range. Preferred thermochromic compounds, have excellent thermal stability and little light absorption in the visible light region, i.e., they impart little or no color to the coatings and substrates to which they are applied. Preferably, they are transparent or invisible to the naked human eye under ambient light at ambient temperature (about 20° C.).

Suitable thermochromic compositions include those described in U.S. Pat. Nos. 5,292,855; 5,423,432; 5,336,714; 5,461,136; 5,397,819; 5,703,229; 5,614,088; 5,665,151; 5,503,904; 4,425,161; 5,427,415; 5,500,040; 5,583,223; 5,595,955; 5,690,857; 5,826,915; 6,048,347 and 6,060,428. These include the conventional electron donor/electron-accepting combinations known in the art. Examples of electron donor compounds are described in U.S. Pat. No. 4,425,161 and include diarylphathalides, such as crystal violet lactone, polyarylcarbinols, leucoauramines, Rhodamine B lactams, indolines, spiropyrans and fluorans. Examples of electron-acceptor compounds are also described in U.S. Pat. No. 4,425,161 and include triazol compounds, thioureas, phenols, phenol resins, benzolthiozols, carboxylic acids, and metal salts thereof and phosphorous esters and metal salts thereof.

The thermochromic compositions typically also include one or more "sensitizers" which can control the temperature at which color change occurs. Examples of sensitizer compounds include ketones, carboxylic acids, acid amides, hydrazides, alcohols, esters and phenols. Preferred thermochromic compositions are microencapsulated. Such microcapsules can be dispersed in a slurry, preferably a neutral aqueous slurry or can be dried to a dried powder. The encapsulant can vary widely in composition and include epoxy resins and polyurea resins. Microencapsulation can be performed by any conventional microencapsulation technique such as interfacial polymerization as described in U.S. Pat. Nos. 3,429,827 and 3,167,602, in situ polymerization as described in British Patent No. 989264, coacervation from an aqueous solution system as described in U.S. Pat. Nos. 2,800,457 and 3,116,206, a suspension coating method as described in U.S. Pat. No. 3,202,533, spray drying as described in U.S. Pat. No. 3,016,308 and the like. The microcapsules can be of a conventional size which are typically about 30 microns or less.

Encapsulated thermochromic compositions are preferably employed as printing ink formulations which comprise from about 1% by weight to about 50% by weight of the encapsulated thermochromic material. Preferred levels range from about 5% by weight to about 40% by weight of the microencapsulated thermochromic composition, based on the total weight of the printing ink.

These thermochromic printing inks may optionally contain a binder for the thermochromic composition or microencapsulated thermochromic material which does not react with the reactive compounds of the thermosensitive coating. These can include polymers such as hydrocarbon resins, polyester resins, polyurethane resins, epoxy resins, melamine resins and others discussed below.

The thermochromic prinking inks containing a thermochromic composition can have a solids content which ranges widely such as from 1 to 95 wt. % of the inks which includes the thermochromic composition, the binder components and other additives. For flexographic printing, a solids levels preferred for conventional flexographic printers such as those provided by Wolverine and Mark Andy are suitable. Solids levels which are conventional for lithographic inks are suitable when applying the thermochromic compound by lithographic printing.

The vehicle used in the thermochromic printing ink preferably dries by evaporation at a temperature below 50° C. and most preferably is aqueous based. Vehicles based on organic solvents can be used if they do not pre-react the thermosensitive layer or cause the loss of the color-forming properties of the thermosensitive layer. Vehicles which dry by gelation, polymerization or solidification are also suitable.

The thermochromic printing inks preferably comprise an aqueous-based carrier so as not to pre-activate the thermosensitive layer or cause the loss of the color-forming properties of the thermosensitive layer. The carrier or vehicle can comprise an aqueous solution with or without a water soluble, dispersible or emulsifiable organic solvent which does not activate the thermal paper. The aqueous-based carrier may contain a dispersing agent to help solubilize the thermochromic compounds within the ink.

The thermochromic printing ink is preferably dried on the thermal paper by the evaporation of water and/or other volatile solvents/components within the ink to leave a solid layer. The binder compounds of the carrier and the amount thereof can vary widely, depending on the method intended to be employed for depositing the security ink on the base layer. For example, the amount of carrier, e.g. water, used can vary from 15 to 70 wt. % based on the total weight of the thermochromic printing ink.

The thermochromic composition and vehicle employed will depend on the printing equipment to be used. Thermochromic inks used in jet printing cannot contain large pigment particles or other solids in that they will clog the small orifices of the jet. The vehicle must also dry rapidly as well. Coating formulations applied by flexographic printing, gravure, wet-offset printing, lithography and relief printing, do not suffer from such limitations and can contain pigments of a relatively large particle size.

Preferably, a special apparatus is not needed to detect the presence of the thermochromic composition and simply rubbing the image or mark with a finger will generate a color shift. Devices which will excite the thermochromic composition include incandescent light sources, hot air dryers, resistance heaters, and other radiant energy sources which emit heat or infrared radiation. Preferred heat sources are those which can heat the surface of the thermosensitive compound to a temperature above ambient temperature but less than the temperature of activation of the thermosensitive layer, i.e., about 21° C. to 51° C.

The thermochromic compound typically has a defined temperature range at which the color shift is actuated. For example, thermochromic inks with actuator temperatures in the following ranges are commercially available from SICPA:

1° C. to 12° C. (33.8° F. to 53.6° F.)
22° C. to 31° C. (71.6° F. to 87.8° F.)
24° C. to 33° C. (75.2° F. to 91.4° F.)
27° C. to 36° C. (80.6° F. to 96.8° F.) and
32° C. to 41° C. (89.6° F. to 105.8° F.).

The thermochromic printing ink may contain additives such as resin binders discussed below, as well as pH stabilizers, UV stabilizers, surfactants, colored pigments, defoamers and plasticizers. The nature of these additives will depend on the end use.

The thermochromic print inks used on the thermosensitive recording media of this invention may comprise a thermoplastic resin binder component. Thermoplastic resins suitable as binders include polyvinyl chloride, polyvinyl acetate, vinyl chloride-vinyl acetate copolymers, polyethylene, polypropylene, polyacetal, ethylene-vinyl acetate copolymer, ethylenealkyl(meth)acrylate copolymer, ethylene-ethylacetate copolymer, polystyrene, styrene copolymers, polyamide, ethylcellulose, epoxy resin, polyketone resin, polyurethane resin, polyvinylbutryl, styrenebutadiene rubber, nitrile rubber, acrylic rubber, ethylene-propylene rubber, ethylene alkyl(meth)acrylate copolymer, styrene-alkyl(meth)acrylate copolymer, acrylic acid-ethylene-vinylacetate terpolymer, saturated polyesters and sucrose benzoate. To obtain emulsions of polymers which are insoluble or partially soluble in water, the resin is typically ground to submicron size.

Thermosensitive recording media which contain a thermochromic security feature can be prepared by printing a mark or image with a thermochromic printing ink having a thermochromic composition therein on the side opposite the thermosensitive coating using conventional printing equipment. The printing operation preferably does not require temperatures above 125° F. (51° C.). Examples include relief printing, flexography, wet-offset, lithography and gravure. Flexographic printing and lithographic printing are preferred, particulary where other indicia are printed on the thermal paper by the same technique, i.e., either flexographic or lithographic printing. Where the thermochromic printing ink is applied to a base sheet of a thermal paper prior to application of the thermosensitive layer, the printing operation/procedure is not limited by temperature. Where the thermochromic printing ink is applied after application of the thermosensitive coating, only methods which do not require elevated temperatures, above 125° F. (51° C.) can be used. Once the thermochromic printing ink is applied to a base sheet with a thermosensitive coating, it is dried at temperatures preferably less than 51° C., most preferably at ambient temperature. Suitable commercially available thermochromic printing inks active at temperatures in the range of 21°–51° C. include: 744020TC (thermochromic blue), 744010TC (thermochromic turquoise), 744027TC (thermochromic yellow), 734010TC (thermochromic rose), 724010TC (thermochromic orange), 754027TC (thermochromic green) sold by SICPA Securink Corp. Springfield, Va. Included are the thermochromic inks which lose color when heated, i.e., change from a color to clear. This includes the compounds 138000TC5 (rose/clear) and 178002TC (Blue/clear) available from SICPA Securink Corp. which are active at 1° C.–12° C. Marks and images made of these compounds are colorless at ambient temperature and change color when cooled. The compound 178002TC (Black/clear) from SICPA Securink Corp. is active at 27° C.–36° C. Compounds from SICPA Securink Corp. which are active at 22° C.–31° C. include: 128001TC (orange/clear), 1384175TC (rose/clear), 150015TC (green/clear), 148003TC (blue/clear), 178000TC (black/clear), 14001TCBR (blue/red) and 128001TCY (orange/yellow). Compounds from SICPA Securink Corp. which are active at 24° C.–33° C. include: 118000TC (yellow/clear), 128002TC (orange/clear), 138103TC (vermillion/clear), 15002TC (green/clear), 14001TC (blue/clear), 14000TCBR (blue/red) and 128002TC (orange/yellow). Compounds from SICPA Securink Corp. which are active at 32° C.–41° C. include: 13001TC (rose/clear), 148002TC (blue/clear), 178001TC (black/clear) and 178002TCBR(blue/red).

To provide the thermochromic printing ink, the components are typically combined as dispersions at about 30 wt. % solids in a ball mill or similar conventional grinding equipment and agitated and ground, without rupturing the microcapsules. Where a resin emulsion is used, it is typically the initial material and the remaining components are added thereto with minor heating. Fluorescent inks may be added to provide another mode of security.

The thermochromic mark or image printed on the reverse side of the thermosensitive recording medium is overcoated with a protective coating so as not to insulate the thermochromic mark or image from heat. The coating preferably has a thickness of from 0.05 to 2.0 mils. It should be recognized that higher thicknesses will not affect the chemical activity of the thermosensitive coating for the thermosensitive recording media. However, the thermochromic mark or image will be more difficult to activate with thicker protective coatings because of the insulation effect.

The overcoat is preferably applied by the same printing method employed to print the thermochromic mark or image with the thermochromic ink. Flexographic and lithographic printing methods are preferred for both applying the thermochromic printing ink and the protective overcoat. The overcoat can vary significantly in composition from a UV cured polymer coat to a heat cured polymer coating cured at temperatures of up to 120° F. to a condensed polymer coating where the ink air dries. This overcoating serves to protect these thermochromic composition from interacting with the thermosensitive layer of the thermosensitive recording medium when stored on a roll.

Conventional coatings deposited over the thermosensitive layer of the thermosensitive recording medium can be used as a protective layers for the thermochromic mark or image. Examples include acrylate coatings, varnishes, polyvinyl alcohol coatings, polyvinyl chloride coatings, styrenated layers and styrenated maleic anhydride layers as described in U.S. Pat. No. 5,843,864 and cellulose binders with a synthetic wax, as described in U.S. Pat. No. 4,740,495.

Suitable UV cured protective overcoats are described in U.S. Pat. No. 4,886,744. Most free radical initiated polymerizations can be suitably cured with the use of a photoinitiator that is responsive in the UV range. These UV overcoats are said to contain additives such as UV absorbers and light stabilizers. Employing the UV cured coating allows for rapid drying. U.S. Pat. No. 4,886,774 discloses the use of a coating comprising the reaction product of acrylated aromatic urethane oligomers as unsaturated oligomer, tetrahydrofural methacrylate, as methacrylate oligomer and trimethylolpropane triacrylate as crosslinking monomer. U.S. Pat. No. 5,158,924 also describes ultraviolet curing resins which are suitable for protective coatings and include urethane resins, epoxy resins, organosiloxane resins, polyfunctional acrylate resins, melamine resins, thermoplastic resins having high softening points such as fluorine plastics, silicone resins, and polycarbonate resins. A specific example of a urethane acrylate-type UV curing resin is UNIDIC C7-157 made by Dainippon Ink & Chemicals Incorporated.

The entire disclosure of all applications, patents, publications, cited above and below, are herein incorporated by reference.

EXAMPLES

Example 1

Thermal Paper

Commercially available thermal papers consisting of substrate paper, base coat and active (thermosensitive) coat are used.

The base coat (40% solids) comprises conventional base coat components such as pigments/binders to produce a level surface for the thermosensitive coat coating.

The active coat comprises conventional active coat components such as the dye ODB-2, a bisphenol-A coreactant, a sensitizer and a stabilizer.

The Thermochromic Printing Ink

The thermochromic printing ink used is water-based and sold by SIPCA Securink Corp. of Springfield, Va. The ink responds with color changes at temperatures in the range of 21° C. to 41° C. This thermochromic printing ink is printed on the side of paper (5) opposite the thermosensitive layer, as shown in FIG. 1 and described above using a Mark Andy 830 Flexopress. The ink printed forms a transparent image, such as image (10) of FIG. 1, which is the NCR Corporation logo.

Protective Coating

An acrylate overcoat (30) is formed over the thermochromic compound by applying a UV curable acrylate coating over the NCR logo with a Mark Andy 830 flexopress and exposing the coating to a UV lamp.

Security Test

Portions of the "NCR" logo or the complete logo are detected as pink markings (20) both during and after the press run with the application of heat by rubbing the image with a finger.

Example 2

A lithographic ink is printed on a thermal paper as described in Example 1 on the side opposite the thermosensitive layer. The lithographic ink is a conventional oil-based ink with conventional thermochromic compounds, an example of which changes color at temperatures in the range of 21° C. to 41° C. This lithographic ink is printed on the thermal paper as described above using a conventional lithopress. The ink printed forms a transparent image as in Example 1. A varnish is applied over the transparent image, also by a lithographic press, forming an overcoat above this image. Portions of the image (or the complete image) are detected with the application of heat by rubbing the image with a finger.

BRIEF DESCRIPTION OF THE DRAWINGS

FIG. 1 illustrates thermal paper of the present invention, at a viewing angle of 90° from the plane of the surface, having a thermochromic image printed thereon, which has been rubbed with a finger.

The preceding examples can be repeated with similar success by substituting the generically or specifically described reactants and/or operating conditions of this invention for those used in the preceding examples.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A thermosensitive recording material comprising a base sheet, with a thermosensitive coating on one side of said base sheet and a mark or image comprising a thermochromic composition printed on the opposite side of said base sheet and a protective coating positioned over said mark or image, wherein the thermochromic composition changes color when heated to a temperature of 21° C. and above, and wherein the thermochromic composition and protective coating do not cause premature reaction of the thermosensitive coating or cause the loss of the color-forming properties of the thermosensitive coating.

2. A thermosensitive recording material as in claim 1, wherein the amount of the thermochromic composition within said mark or image is sufficient such that a color change can be sensed by the naked human eye when heated to a temperature of 21° C. to 51° C.

3. A thermosensitive recording material as in claim 1, wherein the thermochromic composition provides a color change when heated to a temperature within a range selected from the group consisting of 27° C. to 36° C., 22° C. to 31° C., 24° C. to 33° C. and 32° C. to 41° C.

4. A thermosensitive recording material as in claim 1, wherein the protective coating positioned over said mark or image is UV cured.

5. A thermosensitive recording material as in claim 4, wherein the UV cured protective coating has a thickness of 0.05–2.0 mils.

6. A thermosensitive recording material as in claim 1, wherein the mark or image is invisible to the naked human eye under illumination with a 60 watt incandescent light bulb at a temperature below 21° C.

7. A thermosensitive recording material as in claim 1 which is a thermal paper.

8. A thermal paper as in claim 7, wherein the thermochromic composition comprises 1 wt. % to 50 wt. % of the mark or image, based on total solids and the protective coating has a thickness of 0.05–2.0 mils.

9. A thermal paper as in claim 7, wherein the thermochromic composition comprises electron-donor compounds, electron-acceptor compounds, and one or more sensitizers.

10. A thermal paper as in claim 9, wherein the mark or image additionally comprises a binder resin.

11. A thermal paper as in claim 10, wherein the thermochromic composition is microencapsulated.

12. A thermal paper as in claim 7 wherein the protective coating comprises a polymer formed by a free radical polymerization initiated with a photoinitiator responsive in the UV range.

13. A thermosensitive recording material as in claim 1, wherein the mark or image comprising a thermochromic composition returns to its original color when cooled to a temperature below 21° C.

14. A thermosensitive recording material as in claim 13, wherein the cooled mark or image comprising a thermochromic composition changes color again when heated to a temperature of 21° C. and above.

15. A method of preparing a thermal paper with a thermochromic composition as a security measure which comprises:

a) providing a thermal paper with a thermosensitive coating on only one side, b) printing a mark or image with a thermochromic printing ink on the side of the thermal paper opposite the thermosensitive coating, said thermochromic printing ink comprising a thermochromic composition and a carrier; and c) overcoating said mark or image with a coating composition, wherein the amount of thermochromic composition incorporated in the mark or image is sufficient to be detected by the naked (unaided) human eye when heated to a temperature of 21° C. and above and the thermochromic printing ink and coating composition do not cause pre-reaction of the thermosensitive coating or cause the loss of the color-forming properties of the thermosensitive coating.

16. A method as in claim 15, wherein the thermochromic ink is printed on the thermal paper by a flexographic printing method, lithographic printing method, or a wet-offset printing method at a temperature less than 50° C.

17. A method as in claim 15, wherein the protective coating is applied at a thickness in the range of 0.05–2.0 mil.

18. A method as in claim 15, wherein the printed mark or image comprising the thermochromic composition provides a color change when heated to a temperature within a range selected from the group consisting of 27° C. to 36° C., 22° C. to 31° C., 24° C. to 33° C. and 32° C. to 41° C.

19. A thermosensitive recording material comprising a base sheet, with a thermosensitive coating on one side of said base sheet and a mark or image comprising a thermochromic composition printed on the opposite side of said base sheet and a protective coating positioned over said mark or image, wherein the thermochromic composition changes color when cooled to a temperature of below 12°, and wherein the thermochromic composition and protective coating do not cause premature reaction of the thermosensitive coating or cause the loss of the color-forming properties of the thermosensitive coating.

20. A thermosensitive recording material as in claim 19, wherein the mark or image is invisible to the naked human eye under illumination with a 60 watt incandescent light bulb at a temperature below 12° C.

* * * * *